United States Patent [19]

Parikh et al.

[11] 4,264,360

[45] Apr. 28, 1981

[54] CHROMIUM MODIFIED SILICON-TIN CONTAINING COPPER BASE ALLOYS

[75] Inventors: Prakash Parikh; Eugene Shapiro, both of Hamden, Conn.

[73] Assignee: Olin Corporation, New Haven, Conn.

[21] Appl. No.: 82,921

[22] Filed: Oct. 9, 1979

[51] Int. Cl.[3] ..... C22C 9/02
[52] U.S. Cl. ..... 75/154; 148/11.5 C
[58] Field of Search ..... 75/154; 148/11.5 C

[56] References Cited

U.S. PATENT DOCUMENTS

| | | | |
|---|---|---|---|
| 3,923,555 | 12/1975 | Shapiro et al. | 148/11.5 A |
| 4,148,633 | 4/1979 | Parikh | 75/154 |

*Primary Examiner*—M. J. Andrews
*Attorney, Agent, or Firm*—Paul Weinstein

[57] ABSTRACT

A copper base alloy and process of treating same. The alloy consists essentially of: about 1.0 to 4.5% silicon; about 1.0 to 5.0% tin; about 0.01 to 0.45% chromium; and the balance essentially copper. Preferably, the chromium level is less than about 0.12% in order to provide good tool wear characteristics.

18 Claims, 3 Drawing Figures

WEAR RATE VS. CHROME CONTENT.

CHROMIUM MODIFIED SILICON-TIN CONTAINING COPPER BASE ALLOYS

BACKGROUND OF THE INVENTION

This invention relates to an improved copper base alloy containing additions of silicon, tin and chromium. The inventive alloys have reduced crack sensitivity during hot rolling, high mechanical strength, excellent stress corrosion resistance and general corrosion resistance, favorable strength to bend ductility characteristics, good stress relaxation resistance particularly in the stabilized condition and preferably reduced tool wear rates.

PRIOR ART STATEMENT

Copper alloys are known containing silicon-tin and one or more other alloying elements as exemplified in U.S. Pat. No. 3,923,555 to Shapiro et al. Chromium in the range of from 0.01 to 2% by weight is disclosed in the Shapiro et al. patent as one of many possible addition elements which could be added to a copper base alloy containing silicon and tin. The Shapiro et al. patent does not disclose a single exemplary alloy including chromium.

In U.S. Pat. No. 4,148,633 to the inventor herein there is disclosed a silicon and tin containing copper base alloy to which mischmetal is added to improve the resistance to edge cracking during hot working of the alloy. Various other elements such as chromium, manganese, iron and nickel may also be added to the alloy to increase its strength properties without affecting the hot workability improvements due to the mischmetal addition. No example alloys including chromium are disclosed in the patent nor is there a recognition that the addition of chromium to a mischmetal free alloy would serve to reduce the crack sensitivity of the alloy during hot working.

While the alloy of the '633 patent is fully acceptable for its intended purpose it is desirable to avoid the addition of mischmetal to copper alloys because of the expense and the highly reactive nature of the mischmetal. It has surprisingly been found that chromium can be substituted for mischmetal in the alloys of the '633 patent while still achieving reduced crack sensitivity during hot working.

In addition, U.S. Pat. Nos. 1,881,257 to Bassett, 1,956,251 to Price, 2,062,448 to Deitz et al., 2,257,437 to Weiser and German Pat. No. 756,035 are illustrative of the wide body of prior art relating to copper alloys including silicon and tin additions.

In copending U.S. patent application Ser. No. 918,333 filed June 22, 1978, now U.S. Pat. No. 4,180,398 to Parikh there is disclosed the addition of chromium to a leaded brass to improve its hot working characteristics and the addition of antimony and bismuth to counteract the adverse affect of chromium on machinability.

SUMMARY OF THE INVENTION

The present invention relates to a copper base alloy particularly adapted for spring applications. The alloy is relatively low in cost as compared to alloys with comparable properties, such as beryllium-copper. The alloy has outstanding stress corrosion resistance, good formability and excellent stress relaxation resistance at room and elevated temperatures.

The copper base alloy of this invention consists essentially of: about 1.0 to 4.5% silicon; about 1.0 to 5.0% tin; about 0.01 to 0.45% chromium; and the balance essentially copper.

A preferred copper base alloy in accordance with this invention consists essentially of: about 1.0 to 4.5% silicon; about 1.0 to 5% tin; about 0.01 to 0.12% chromium.

Preferably, the ranges for silicon and tin comprise about 2.0 to 4.0% silicon and about 1.0 to 3.0% tin with the silicon plus tin content being less than about 6.0%.

Most preferably, the alloy includes from about 0.01 to about 0.08% chromium.

The alloys formulated as above provide uniquely improved resistance to edge cracking during hot rolling and in the preferred embodiment markedly reduced wear of tooling.

It has surprisingly been found in accordance with this invention that when chromium is added to a silicon-tin containing copper base alloy its cast structure is controlled so that edge cracking during hot working such as by hot rolling is minimized. It has also been surprisingly found in accordance with this invention that the amount of chromium which can be added to the alloy must be restricted within certain critical limits. A maximum upper limit of about 0.45% is dictated by the adverse affect of chromium on the bend ductility of the alloy. Further, such alloys must have an even more restrictive chromium content for application or processing wherein the wear rate on cutting tools or the like is of concern, for example, milling following hot working. For such applications or processing requiring reduced wear rate the chromium content must be restricted below about 0.12% and preferably below about 0.08%.

Accordingly, it is an object of this invention to provide an improved silicon and tin containing copper base alloy having reduced sensitivity to cracking during hot working.

It is a further object of this invention to provide an alloy as above having a reduced wear rate on tooling.

These and other objects will become more fully apparent from the following description and drawings.

DETAILED DESCRIPTION OF PREFERRED EMBODIMENTS

Figure 1:
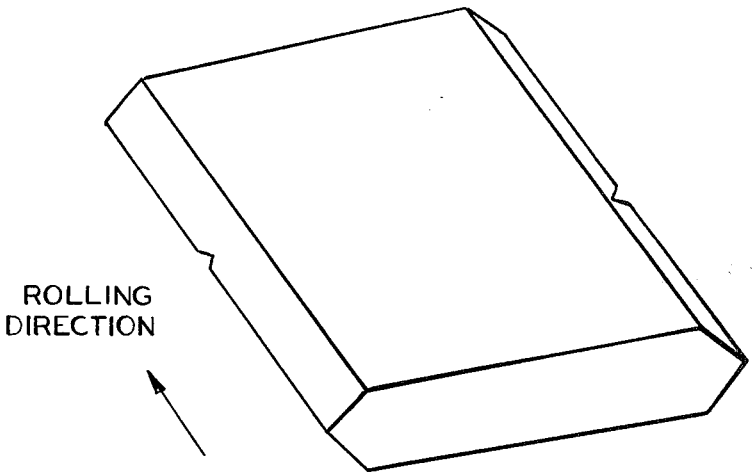
FIG. 1 is a perspective view of an edge cracking performance test specimen.

In accordance with the present invention it has surprisingly been found that when chromium is added to a copper base alloy including substantial additions of silicon and tin the alloy becomes resistant to edge cracking during hot working such as by hot rolling. The chromium addition operates to modify the cast structure of the alloy by refining the size of the interdendritic constituent. This results in the casting being more readily homogenized prior to hot rolling and, therefore, minimizes the occurrence of edge cracking during hot rolling. The effect of chromium on the hot rolling characteristics of the copper base alloy including silicon and tin is believed to be unique.

In accordance with this invention the amount of chromium which may be added to the alloy must be restricted within critical ranges. In the first instance, the chromium content is preferably maintained below about 0.45% in order to provide good bend formability in the alloy. Increasing amounts of chromium above that level tend to reduce the alloys bend formability. In a most preferred embodiment chromium is maintained below about 0.12% in order to avoid undue wear of tools, such as milling cutters, during processing of the alloy or in its fabrication.

In accordance with the present invention a copper base alloy is provided consisting essentially of: about 1.0 to 4.5% silicon; from about 1.0 to 5.0% tin; from about 0.01 to about 0.45% chromium, and the balance essentially copper.

Preferably, the chromium content is from about 0.01 to about 0.12% and most preferably, from about 0.02 to 0.08%. Preferably, the ranges for silicon and tin comprise: about 2.0 to 4.0% silicon and about 1.0 to 3.0% tin with the silicon plus tin content being less than about 6.0%.

All percentage compositions as set forth herein are by weight.

The processing of the alloy system of the present invention generally follows along the same lines as the processing outlined in U.S. Pat. Nos. 3,923,555 and 4,148,633, described above. The disclosures of these two patents are intended to be specifically incorporated by reference herein. In other words, the alloys of the present invention may first be cast by any suitable method and preferably by direct chill or continuous casting methods in order to provide a better cast structure to the alloy. After this casting step, the alloy is preferably heated to between 650° C. and the solidus temperature of the particular alloy within the system for at least 15 minutes. The alloy is then hot worked from a starting temperature in excess of 650° C. up to within 20° C. of the particular solidus temperature. The temperature at the completion of the hot working step should be greater than 400° C. It should be noted that the particular solidus temperature of the alloy being worked will depend upon the particular amounts of silicon, tin and chromium within the alloy as well as any other minor additions present in the alloy. The particular percentage reduction during the hot working step is not particularly critical and will depend upon the final gage requirements necessary for further processing.

After being hot worked, the alloy may then be subjected to an annealing temperature between 450° C. and 600° C. for approximately ½ to 8 hours. This annealing temperature should preferably be between 450° and 550° C. for ½ to 2 hours. This particular annealing step can be utilized either after the hot working step or with subsequent processing of the alloy to make a product. Depending upon desired properties, the alloy can be cold worked to any desired reduction with or without intermediate annealing to form either temper worked strip material or heat treated strip material. A plurality of cold working and annealing cycles may be employed in this particular step of the process.

The processing procedure may contain a heat treatment step either in the interannealing procedure or as a final annealing procedure in order to obtain improvement in the strength to ductility relationship in the alloy. This heat treatment step should be performed at a temperature between 250° and 850° C. for at least 10 seconds. If a heat treatment step is desired in order to provide greater stress relaxation properties, this particular heat treatment step should be performed at a temperature between 150° and 400° C. for from 15 minutes to 8 hours. This latter heat treatment comprises a stabilization anneal. A stabilization anneal is a low temperature thermal treatment performed preferably by the customer after the alloy is formed into its desired shape. This treatment does not significantly change tensile properties but serves to improve the stiffness of the alloy and its stress relaxation resistance.

The alloys of this invention compare very favorably with commercial Alloys CDA 51000, 63800, 76200 and with mill hardened beryllium-copper. The alloys provide excellent bend formability for a given yield strength. Their stress corrosion resistance are believed to be far superior to that of all of the above mentioned commercial alloys in moist ammonia and equivalent or better in Mattson's solution. Their bend formability are believed to be superior to the commercial alloys mentioned except for mill hardened beryllium-copper. Their stress relaxation resistance versus bend formability properties are believed to be superior to the aforenoted commercial alloys and comparable to mill hardened beryllium-copper.

When chromium is added to a copper base alloy including major additions of silicon and tin, it is believed that the chromium combines with silicon and forms chromium-silicide particles. These particles are hard and cause tool wear if present in a large quantity. This can pose a significant problem during the forming of the alloy into a strip or other type article. In conventional practice, the alloy after casting is hot worked usually by rolling at an elevated temperature. The alloy after hot working contains surface scales or oxides which must be removed. This is normally accomplished by milling. When one attempts to mill a copper-silicon-tin alloy including chromium as in accordance with the present invention, if the chromium content is in excess of 0.12% excessive wear of the milling cutters occurs making the process commercially unfeasible. Similarly, it is believed that the alloy even if it could be processed by other means into strip would result in excessive tool wear of cutting, piercing, blanking and other types of tools due to the presence of the chromium-silicides. Therefore, for applications of the alloys where their tool wear characteristics are of concern the chromium content should be maintained less than about 0.12% and preferably, less than about 0.1% and most preferably, less than about 0.08%.

Chromium is a necessary addition to the alloy of the present invention in order to reduce the crack sensitivity of the alloy during hot working. This is best illustrated by a consideration of the following examples.

EXAMPLE I

Tapered edge hot rolling specimens such as that shown in FIG. 1 were cut and formed from 10 lb. castings of alloys having compositions as set forth in Table I.

TABLE I

HOT ROLLING EVALUATION

| Alloy Ident. | Nominal wt. % Si | Sn | Cr | Cu |
|---|---|---|---|---|
| A748 | 3.5 | 2.0 | — | Bal. |
| A823 | 3.5 | 2.0 | 0.01 | Bal. |
| A825 | 3.5 | 2.0 | 0.05 | Bal. |
| A778 | 3.5 | 2.0 | 0.20 | Bal. |
| A784 | 3.5 | 2.0 | 0.50 | Bal. |

TABLE I-continued

| HOT ROLLING EVALUATION | | | | |
|---|---|---|---|---|
| | Nominal wt. % | | | |
| Alloy Ident. | Si | Sn | Cr | Cu |
| A810 | 3.5 | 2.0 | 0.80 | Bal. |

The alloys in Table I were cast utilizing the same conventional casting practice and the alloy specimens were soaked at 750° C. for one hour prior to hot rolling. The specimens utilized both tapered edges and notches since the taper induces tensile stress at the edges while the notch promotes stress concentration. Both of these stress concentration situations simulate conditions of an alloy sheet edge during commercial hot rolling of large ingots. After the one hour soak at 750° C., the samples were hot rolled at 750° C. with two passes of approximately 20% reduction during each pass. The tapered edge was then specifically examined to determine the cracking tendency of each sample.

The edge cracking performance of the alloys as determined visually are summarized in Table II.

TABLE II

| Alloy Ident. | Edge Cracking Performance |
|---|---|
| A748 | Severe |
| A823 | Mild to severe |
| A825 | Mild |
| A778 | None |
| A784 | None |
| A810 | None |

The data presented in Table II clearly establishes that chromium must be present at least in the amount of 0.01% and preferably, above 0.03%. Chromium is effective for reducing the incidence of edge cracking during hot rolling even in amounts as demonstrated up to 0.8%. However, as enumerated above and as will be demonstrated hereafter, chromium in such large amounts adversely affects the bend formability of the alloy as well as increasing the volume fraction of chromium-silicides in the alloy and thereby its wear resistance.

Severe edge cracking in commercial practice causes considerable waste in the forming of these alloys into useful wrought shapes. Therefore, the alloys in accordance with this invention with reduced edge cracking not only take full advantage of the properties of such alloys, but also provide for increased productivity in the formation of wrought products from such alloys.

The effect of chromium on the bend formability of the alloys of this invention will now be illustrated by reference to the following example.

EXAMPLE II

Two copper-silicon-tin-chromium alloys with different chromium levels as set forth in Table III were cast.

TABLE III

| Effect of Cr on Bend Ductility | | | | |
|---|---|---|---|---|
| | Nominal wt. % | | | |
| Alloy Ident. | Si | Sn | Cr | Cu |
| A738 | 2.8 | 2.3 | 0.5 | Bal. |
| Z | 2.8 | 1.8 | 0.2 | Bal. |

The alloys were then hot rolled, cold rolled and stabilization annealed to a 0.03" gauge. Minimum bend radiuses uses for a 90° bend were determined. The minimum bend radius comprises the minimum radius to which a specimen can be bent before the detection of a crack with a 10X eyepiece. The results of the tests are summarized in Table IV.

TABLE IV

| Bend Formability Data | | |
|---|---|---|
| Alloy Ident. | After Stabilization 0.2% Yield Strength ksi | Bad Way $MBR/_t$ |
| A738 | 89 | 2.1 |
| A738 | 101 | 3.9 |
| A738 | 112 | 6.3 |
| A738 | 117 | 9.4 |
| Z | 81 | 1.2 |
| Z | 121 | 7.1 |

The $MBR/_t$ values represent the minimum bend radius normalized to the thickness of the strip. It is apparent from a consideration of Table IV that increasing chromium content adversely affects the bend formability of the alloy at comparable yield strengths. The effect is most significant in the spring tempers or higher yield strength alloys. Therefore, in accordance with this invention when the wear resistant properties of the alloy are not of concern but good bend formability is required it is preferred to maintain the chromium content below about 0.45%.

The adverse effect of chromium on the tool wear properties of the alloys of this invention are illustrated by reference to the following example.

EXAMPLE III

Several copper-silicon-tin-chromium alloys with different chromium levels were tested having compositions set forth in Table V.

TABLE V

| NOMINAL COMPOSITION OF ALLOYS FOR TOOL WEAR STUDY | | | | |
|---|---|---|---|---|
| | Wt. % | | | |
| Alloy Ident. | Cu | Si | Sn | Cr* |
| A722 | 95.50 | 2.7 | 1.8 | — |
| A718 | 94.50 | 3.2 | 2.3 | — |
| C666 | 96.36 | 3.1 | 1.5 | 0.04 |
| C665 | 96.32 | 3.1 | 1.5 | 0.08 |
| 509964 | 95.15 | 3.2 | 1.5 | 0.15 |
| A738 | 94.40 | 2.8 | 2.3 | 0.50 |

*Cr analyzed

Figure 2:
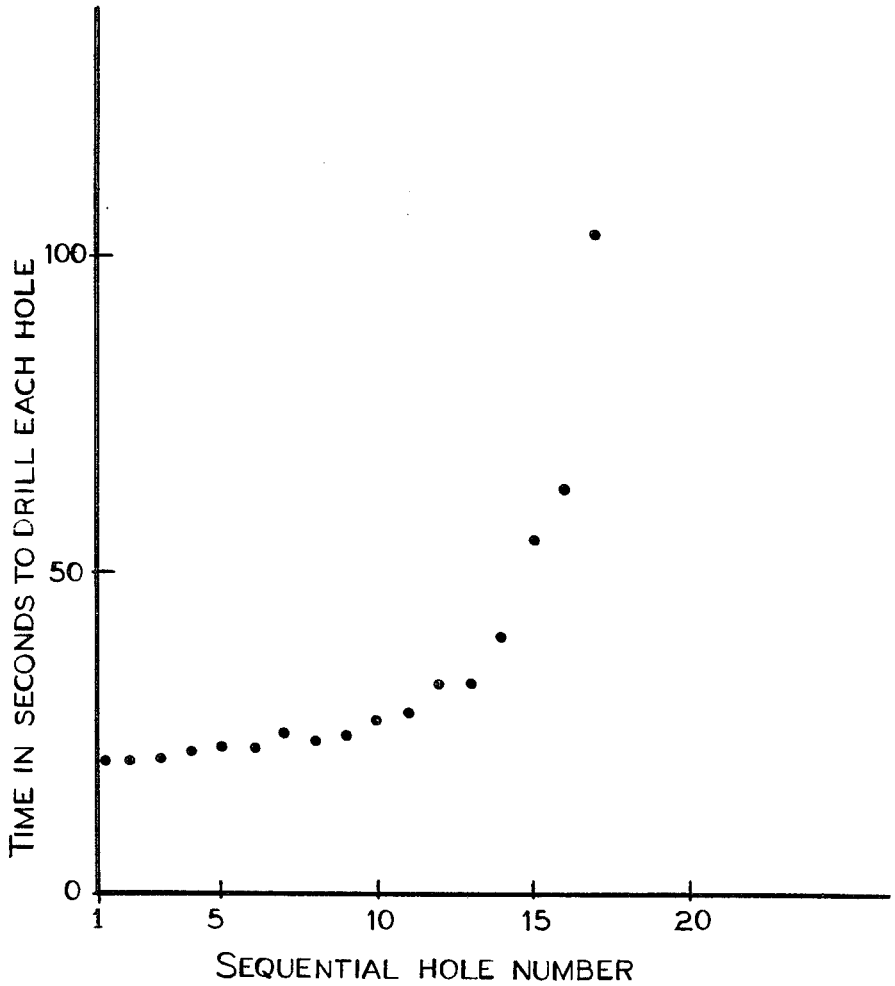
FIG. 2 is a graph showing the change in time to drill successive holes in a drill machinability test.

All the alloys were tested as hot rolled to about 0.5" gauge after the surface oxide layer was removed by milling. A drill machinability type of test was used to measure tool wear. About twenty holes were drilled in each alloy plate starting with a new ¼" diameter drill and the time to drill each hole with the same drill bit was recorded. A typical plot of time to drill successive holes versus number of holes is shown in FIG. 2. The average slope of this curve in seconds per hole is a measure of tool wear rate. In the plot of FIG. 2 the average slope or wear rate comprises 12.7 seconds per hole. This is determined by taking the total time to drill all the holes (236 seconds in FIG. 2), subtracting the time to drill the first hole (20 seconds in FIG. 2) and then dividing by the total number of holes (17 in FIG. 2).

Table VI summarizes the wear rate for the various alloys tested as set forth in Table V.

TABLE VI

| WEAR RATE DATA | | | |
|---|---|---|---|
| Alloy Ident. | % Cr | Average Hole Depth, Inc. | Wear Rate, Secs./Hole |
| A722 | 0 | 0.12 | Approaching 0 |
| A718 | 0 | 0.12 | Approaching 0 |
| A666 | 0.04 | 0.12 | 0.42 |
| A665 | 0.08 | 0.11 | 12.7 |
| 509965 | 0.15 | 0.11 | >300* |
| A738 | 0.50 | — | >>>300** |

*Only two holes could be drilled
**Could not complete first hole

Figure 3:
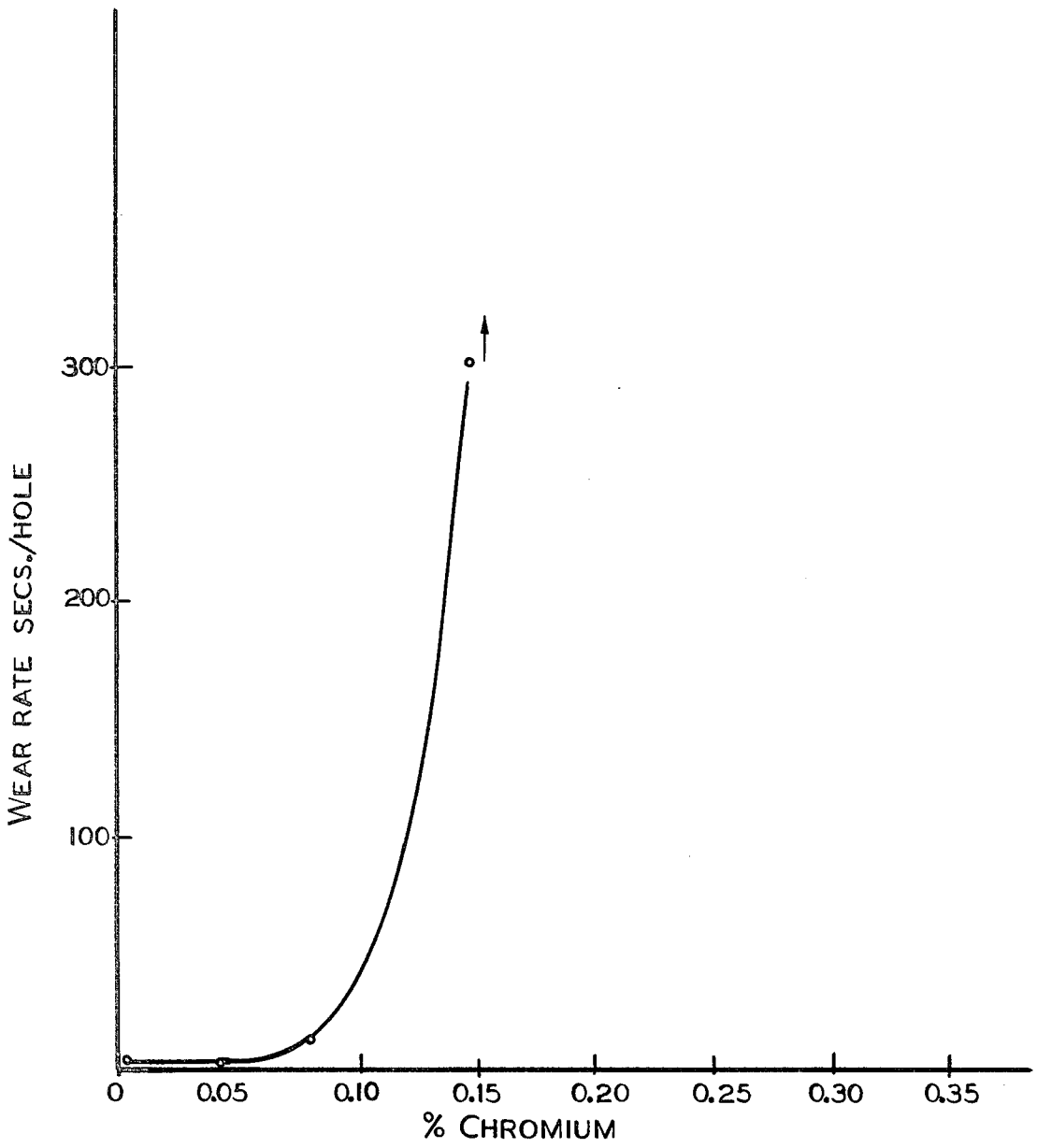
FIG. 3 is a graph showing wear rate for alloys in accordance with this invention versus chromium content.

The data in Table VI are plotted as wear rate versus chromium content in FIG. 3. It is quite evident that above 0.08% chromium the wear rate increases rapidly thereby this is a critical limit for alloys in accordance with this invention which cannot have high wear rates. It is believed that wear rates for alloys having chromium up to about 0.12% could be employed for many applications. Above that level of chromium the wear rate tends to go up asymptotically making the alloys useless for applications wherein tool wear is a concern such as blanking, forming and cutting.

Table VII records the average number of particles per square inch for Alloys A666, A665, 509965 and A738 as in Table V.

TABLE VII

| VOLUME FRACTION OF PARTICLES | | | |
|---|---|---|---|
| Alloy Ident. | % Cr | Particles/In.$^2$ | Wear Rate, Secs./Hole |
| A666 | 0.04 | 1200 | 0.42 |
| A665 | 0.08 | 2400 | 12.7 |
| 509965 | 0.15 | 3200 | >300* |
| A738 | 0.50 | 4800 | >300** |

*Only two holes could be drilled
**Could not complete first hole

It is apparent from a consideration of Table VII that the wear rate decreases with decreasing particle volume fraction. Therefore, the chromium content of the present alloys should be restricted below 0.12% and preferably below 0.08%.

Unless otherwise excluded by the claims appended hereto other elements can be added to the alloys of this invention if they do not materially adversely affect the basic and novel properties and characteristics of the alloys.

In the visual determination of edge cracking performance in Example I the reported degree of cracking is a function of the number and depth of the cracks with the depth being most important. Cracks less than ¼" deep would be considered mild whereas cracks ½ to 1" deep would be considered severe.

The U.S. patents set forth in this application are intended to be incorporated by reference herein.

It is apparent that there has been provided in accordance with this invention chromium modified silicon-tin containing copper base alloys which fully satisfy the objects, means and advantages set forth hereinbefore. While the invention has been described in combination with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. A mischmetal free copper base alloy having improved resistance to cracking during hot rolling and good bend formability, consisting essentially of: about 1.0 to 5.0% tin; about 1.0 to 4.5% silicon; about 0.01 to 0.45% chromium; and the balance essentially copper.

2. An alloy as in claim 1 wherein said silicon is about 2.0 to 4.0%, said tin is about 1.0 to 3.0% and the sum of said silicon and tin is less than about 6.0%.

3. A copper base alloy having improved resistance to cracking during hot rolling, good bend formability and good tool wear characteristics, consisting essentially of: about 1.0 to 5.0% tin; about 1.0 to 4.5% silicon; about 0.01 to 0.12% chromium; and the balance essentially copper.

4. An alloy as in claim 3 wherein said silicon is about 2.0 to 4.0%, and said tin is about 1.0 to 3.0% and wherein the sum of said silicon and tin content is less than about 6.0%.

5. An alloy as in claim 4 wherein said chromium is about 0.03 to about 0.12%.

6. An alloy as in claim 4 wherein the maximum chromium content is 0.08%.

7. An alloy as in claim 6 wherein a volume fraction of chromium-silicide particles per square inch in the microstructure of said alloy is less than about 2400.

8. An alloy as in claim 1 in the stabilization annealed condition.

9. A process for forming an alloy which exhibits high resistance to edge cracking during hot working and good bend formability, said process comprising:

(a) providing a mischmetal free copper base alloy which consists essentially of about 1.0 to 4.5% silicon; about 1.0 to 5.0% tin; about 0.01 to 0.45% chromium; and balance essentially copper;

(b) hot working said alloy from a starting temperature in excess of 650° C. up to within 20° C. of the solidus temperature of the alloy, with a temperature at the completion of the hot working step in excess of 400° C.;

(c) cold working the alloy to the desired gage; and (d) annealing the alloy at a temperature between 450° and 600° C. for from ½ to 8 hours.

10. A process as in claim 9 wherein prior to hot working the alloy is heated at a temperature between 600° C. and the solidus temperature of the alloy for at least 15 minutes.

11. A process as in claim 9 wherein the alloy is annealed at a temperature between 450° and 600° C. for ½ to 8 hours immediately following said hot working.

12. A process as in claim 9 wherein said cold working and annealing steps are repeated at least once.

13. A process as in claim 9 wherein the annealing temperature is between 450° and 550° C. and the annealing time is between ½ and 2 hours.

14. A process as in claim 9 wherein the product formed from the processing steps is formed into a part and said part is heat treated at a temperature between 150° and 400° C. for from 15 minutes to 8 hours.

15. A process as in claim 9 wherein said silicon is about 2.0 to 4.0%, said tin is about 1.0 to 3.0% and the sum of said silicon and tin is less than about 6.0%.

16. A process as in claim 9 wherein said process is adapted to form an alloy with good tool wear characteristics and wherein the step (a) in said process comprises: providing a copper base alloy which consists essentially of about 1.0 to 4.5% silicon; about 1.0 to 5.0% tin; about 0.01 to 0.12% chromium; and the balance essentially copper.

17. A process as in claim 16 wherein said chromium is about 0.03 to about 0.12%.

18. A process as in claim 16 further including a stabilization anneal at a temperature between 150° and 400° C. for from 15 minutes to 8 hours.

* * * * *